US010414572B2

(12) United States Patent
Pan

(10) Patent No.: US 10,414,572 B2
(45) Date of Patent: Sep. 17, 2019

(54) FRESH-KEEPING BOTTLE

(71) Applicant: ANHUI MINGZHUANG PLASTIC INDUSTRY CO. LTD, Xuancheng, Anhui (CN)

(72) Inventor: Jinqing Pan, Xuancheng (CN)

(73) Assignee: ANHUI MINGZHUANG PLASTIC INDUSTRY CO. LTD, Xuancheng (CN)

( * ) Notice: Subject to any disclaimer, the term of this patent is extended or adjusted under 35 U.S.C. 154(b) by 0 days.

(21) Appl. No.: 15/973,337

(22) Filed: May 7, 2018

(65) Prior Publication Data

US 2018/0319566 A1 Nov. 8, 2018

(30) Foreign Application Priority Data

May 8, 2017 (CN) ..... 2017 2 0503659 U
May 8, 2017 (CN) ..... 2017 2 0503671 U

(51) Int. Cl.

| | |
|---|---|
| ***B65D 81/32*** | (2006.01) |
| ***B65D 1/02*** | (2006.01) |
| ***B65D 41/34*** | (2006.01) |
| ***B65D 83/00*** | (2006.01) |
| ***B65D 51/00*** | (2006.01) |
| ***B65D 51/24*** | (2006.01) |

(52) U.S. Cl.

CPC ..... *B65D 81/3211* (2013.01); *B65D 1/0207* (2013.01); *B65D 1/0246* (2013.01); *B65D 41/3428* (2013.01); *B65D 41/3438* (2013.01); *B65D 41/3457* (2013.01); *B65D 51/002* (2013.01); *B65D 51/24* (2013.01); *B65D 81/3222* (2013.01); *B65D 83/0094* (2013.01)

(58) Field of Classification Search

CPC ..... B65D 81/3211; B65D 81/3222; B65D 83/0094; B65D 1/0207; B65D 1/0246; B65D 41/3428; B65D 41/3438; B65D 41/3457; B65D 51/002; B65D 51/24

See application file for complete search history.

(56) References Cited

U.S. PATENT DOCUMENTS 4,103,772 A * 8/1978 Wiegner ..... B65D 81/3222 206/222
4,174,035 A * 11/1979 Wiegner ..... B65D 81/3222 206/222
4,693,706 A * 9/1987 Ennis, III ..... A61M 5/31596 604/220

(Continued)

*Primary Examiner* — Frederick C Nicolas
(74) *Attorney, Agent, or Firm* — Maschoff Brennan

(57) ABSTRACT

A fresh-keeping bottle includes a volumetric bottle having a bottle cap, a bottle body and a base. The upper end of the bottle body has a liquid squeezing outlet. The lower part of the bottle body is fixed with the base that includes a flexible bottle bottom and a cylindrical support. The upper edge of the bottle bottom is fixed in the inner wall of the cylindrical support. The liquid can be squeezed from the fresh-keeping bottle by pressing with a single hand without leakage. Solid and liquid materials can be separately packed at the upper and lower parts of a package bottle through tinfoil, which is punctured through sharp protrusion of the bottle bottom to mix the solid and liquid materials. The bottle keeps the powder fresh in transmission and storage and can simply mix the solid and liquid material together without needing special work when in use.

13 Claims, 10 Drawing Sheets

(56) References Cited

U.S. PATENT DOCUMENTS

| | | | | | |
|---|---|---|---|---|---|
| 4,821,875 | A * | 4/1989 | Groves | B65D 81/3211 | 206/219 |
| 5,127,548 | A * | 7/1992 | Brunet | A61J 1/20 | 222/145.1 |
| 6,364,103 | B1 * | 4/2002 | Sergio | A61L 2/18 | 141/330 |
| 6,997,357 | B2 * | 2/2006 | Fuchs | A61M 15/0028 | 206/222 |
| 7,832,594 | B2 * | 11/2010 | Yamada | A61F 9/0008 | 222/189.06 |

* cited by examiner

A-A section view

B-B section view

FRESH-KEEPING BOTTLE

TECHNICAL FIELD

The present invention relates to a liquid or powder solid and liquid separated package bottle, and more particularly, to a liquid or solid fresh-keeping bottle.

BACKGROUND ART

A liquid used through dropwise adding is generally filled in a flexible plastic bottle, wherein the front end of the bottle is provided with a very small liquid squeezing outlet, the liquid squeezing outlet is provided with a cap, the cap is taken off when the bottle is used, the plastic bottle is squeezed through squeezing, but the liquid will be squeezed to the periphery of the flexible plastic bottle in this type of package usually, so that the liquid in the bottle flows out from the liquid squeezing outlet; although the liquid squeezing outlet is provided with the cap, when you take off the cap to use next time, a lot of liquid will be spilled out of the liquid squeezing outlet, which causes unclean periphery of the liquid squeezing outlet, so as to effect the use due to oxidative deterioration.

In order to solve the problems above, there is a fresh-keeping bottle in the current market, wherein the fresh-keeping bottle is made of hard plastic, and the bottle bottom is provided with a manual piston; when the piston is manually pushed to move inwardly, the inner volume of the fresh-keeping bottle is decreased, the volume occupied by the air is decreased, which causes the increase of the air pressure, so that the liquid is pushed to flow out from the liquid squeezing outlet. However, the movement of the piston refers to surface-surface contact, which is easy to cause the liquid in the fresh-keeping bottle to leak; moreover, the consumer needs to operate by two hands at the same time when in use to drop out the liquid, but cannot hold the material liquid with a free hand, so that it is inconvenient to use. Therefore, it is necessary to improve the structure thereof. The form of the product material not only is in a liquid state, but also is mainly in powder solid; however, in order to guarantee even concentration or the security under low-concentration application when in use, the powder solid material is dissolved by solvent usually to use, but since the usage amount of the solvent is too much, the solid material in a solution state brings about much inconvenience to storage and transmission, and moreover, partial powder solid material dissolved in the solvent is easy to cause material denaturation, such as oxidation, hydrolysis or polymerization, which causes effect decrease and reduction of polymerization efficiency. Therefore, the powder solid material and the solvent are usually packed independently, and are mixed before being used, which is very beneficial or simple for industrial production.

In the field of medicine, the most common method is adopted in lyophilized powder, i.e., powder solid material and liquid solvent are independently packed. Normal saline or glucose used as a solvent has became an ordinary product; before use, a nurse can firstly mix and dissolve the powder with the solvent to use. However, as the powder needing to be dissolved for civil purpose, general families will not prepare an injection syringe; even if other sharp tools can be used, this package is inconvenient for people away from home to carry and use. Moreover, no proper tool can be found when using the mixture of the two by dropping.

SUMMARY OF THE INVENTION

Regarding to the demands in the field above, the present invention provides a fresh-keeping bottle, through which the liquid can be easily squeezed from a liquid squeezing outlet through pressing by single hand without having liquid leakage at the same time, which avoids the liquid from flowing out due to careless squeezing and collision. Meanwhile, a preferred solution of the present invention can further satisfy to separately pack powder solid and liquid in a package bottle; for the powder solid material, the invention plays a role of keeping the freshness in the processes of transmission and storage, and no special work is needed when in use; moreover, the powder solid and the liquid can further be simply mixed together to both facilitate carrying and using.

A fresh-keeping bottle comprises a volumetric bottle with a bottle cap, wherein the volumetric bottle comprises a bottle body and a base, the upper end of the bottle body is provided with a liquid squeezing outlet, the lower part of the bottle body is fixed with the base, the base comprises a flexible bottle bottom and a cylindrical support, and the upper edge of the bottle bottom is fixed in the inner wall of the cylindrical support.

The upper edge of the bottle bottom is adhered to and fixed with tinfoil, and the inner bottom part inside the bottle bottom is fixed with an upward sharp protrusion.

The wall of the bottle bottom is radially fixed with a hard tiepiece, and the sharp protrusion is fixed on the hard tiepiece in the middle of the bottle bottom.

The bottle body is filled with a liquid, and the bottle bottom is filled with solid powder.

The upper part of the bottle body is shrunk into continuous bottle neck and bottle tip, the bottle neck is in thread tightening with the bottle cap, and the liquid squeezing outlet is located in the bottle tip.

The inner bottom of the bottle cap is provided with a raised ring wall, and the bottle tip is located in the raised ring wall.

The bottle bottom is in a bowl shape or in a cylindrical concave shape; the cylindrical support is clamped in the inner end face of the lower part of the bottle body, or, the cylindrical support is internally rotated in the inside thread of the lower part of the bottle body, or, the cylindrical support is welded on the end face of steps in the lower part of the bottle body or a fractured face in the bottom through ultrasonic wave, or, the cylindrical support is fixed in the lower end of the bottle body after being assembled through another part.

The outside of the end face of the lower part of the bottle body is provided with an annular extension wall along the direction of the bottle body, and the annular extension wall is fixed with the cylindrical support through a buckled sealing structure.

The outer bottom of the bottle bottom in a bowl shape or in a cylindrical concave shape is provided with a concave pressing point, the outside of the end face of the lower part of the bottle body is provided with an annular extension wall along the direction of the bottle body, and the inner wall of the annular extension wall is fixed with the outer wall of the cylindrical support in a buckled sealing manner.

The lower end of the bottle cap is provided with a safety cap, the safety cap is clamped and fixed in the bottle neck, and the bottle cap is connected to the safety cap through a disconnecting point that can be disconnected.

The lower end of the bottle cap is provided with a safety cap, the safety cap is divided into upper and lower parts which are connected through a disconnecting point that can be disconnected, and the upper part of the safety cap is clamped and fixed with the inner wall of the opening at the lower edge of the bottle cap through a clamping structure.

The fresh-keeping bottle further comprises a powder bottle, wherein the bottle opening of the powder bottle is provided with a butyl rubber plug, the middle of the butyl rubber plug is provided with a through hole, tinfoil is adhered to and is fixed with the through hole, and the bottle tip can puncture the tinfoil to penetrate through the through hole and stretch into the bottle opening.

The outside of the bottle opening is clamped and fixed with a cylindrical outer cap with an inner wall provided with a convex ring, the upper end of the outer cap is buckled with a detachable buckle cap, and the inside of the cylindrical outer cap is provided with an inner thread meshed with the bottle neck.

The center of the inside of the cylindrical outer cap is provided with a pressing plate, and the middle of the pressing plate is provided with a pressing plate hole corresponding to the through hole.

The bottle body and the cylindrical support are made of hard plastic PP/PS/AS/MS/PET/PETG and the bottle bottom is made of flexible plastic TPE/TPR/TPU/silica gel/rubber.

The fresh-keeping bottle according to the present invention is designed into two parts of the bottle body and a base, and the design of the base is very special and important. Firstly, the base is convenient for supporting the bottle body, so that the bottle body is guaranteed to be steadily placed on a table surface, and meanwhile, the cylindrical support encloses the bottle bottom, so that the careless squeezing cannot enable the liquid in the bottle to be squeezed out. The liquid can be squeezed from the fresh-keeping bottle according to the present invention through pressing by single hand without leakage, which is convenient for using. Regarding to the preferred fresh-keeping bottle, punctured tinfoil can be used to separate the two parts above, the bottle bottom is a flexible bottom, and the bottle bottom has a sharp protrusion, when the bottle bottom is pressed, the tinfoil is punctured by the protrusion, and the materials in two containers are mixed together. The bottle bottom is formed by injection molding of flexible glue or twice injection molding of flexible glue, and the pressing place has suitable flexibility. The inner wall of the bottle bottom is tightly attached with the hard tiepiece, and the flexible bottle bottom can quickly gets back into the shape after pressing. The liquid and the powder solid can be separately stored in the fresh-keeping bottle according to the present invention, or two different liquids can be separately stored thereof, so that it is convenient for mixing in use, which provides a fresh-keeping effect to the powder solid and the liquid in the storage and transmission process. The liquid can be squeezed out through pressing by single hand without having leakage, which is convenient for using.

Regarding to the fresh-keeping bottle according to the present invention, the bottle bottom and the bottle body are preferably fixed together in a buckled manner, and the existing various buckled fixing models are all applied to the connection and fixation thereof.

The lower end of the bottle cap is provided with the safety cap, the safety cap can only be opened through discontinuity point, so that the fresh-keeping bottle according to the present invention can be opened, and the structure of the safety cap can be anti-fake and burglarproof.

The bottle tip of the volumetric bottle according to the present invention can further be used as the protrusion for puncturing the other powder bottle, the mixed liquid in the bottle is injected in the powder bottle for mixing again, and the two types of power and liquid can be mixed together. Two types of liquid and one type of powder can be mixed together for use, and three types of liquid can also be mixed for use. Many types of liquid, power, solid and oil materials packed can be mixed for use at the same time.

The fresh-keeping bottle with the base is placed downwardly, the flexible bottom is pressed to discharge the air, the mixed powder solution successively flows from the powder bottle into the fresh-keeping bottle, the two bottle bodies are separated in using, and the bottle bottom is slightly pressed to drop out the power solution, which is convenient for use and is healthy.

The fresh-keeping bottle provided by the present invention has special base design; and the liquid can be squeezed out by pressing the bottle bottom only for use without leakage, which is convenient for use. When the solid and the liquid are stored separately, the solid and liquid materials can be separately packed at the upper and lower parts of the package bottle through tinfoil, the tinfoil is punctured through sharp protrusion of the bottle bottom to mix the solid and liquid materials, the fresh-keeping bottle according to the present invention plays a role of keeping the freshness of powder in the processes of transmission and storage, can simply mix the solid and liquid material together without needing special work when in use, and is both convenient to carry and use.

1 refers to volumetric bottle, 2 refers to bottle cap, 3 refers to bottle body, 4 refers to sealing structure, 5 refers to tinfoil, 10 refers to pressing point, 11 refers to hard tiepiece, 12 refers to bottle bottom, 13 refers to support, 14 refers to protrusion, 15 refers to extension wall, 16 refers to bottle neck, 17 refers to bottle tip, 18 refers to ring wall, 19 refers to safety cap, 20 refers to disconnecting point, 21 refers to plug, 22 refers to liquid squeezing outlet, 23 refers to clamping structure, 24 refers to bottle opening, 25 refers to glue plug, 26 refers to through hole, 27 refers to outer cap, 28 refers to buckle cap, 29 refers to pressing plate, and 30 refers to pressing plate hole.

DETAILED DESCRIPTION OF THE PREFERRED EMBODIMENTS

The present invention is further described in detail hereinafter with reference to the drawings.

First Embodiment

Figure 1:
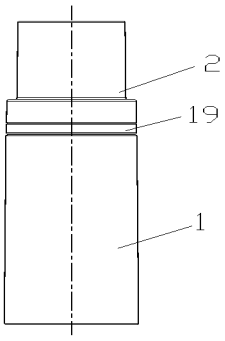
FIG. 1 is a schematic diagram showing an outline shape of a first embodiment.
Figure 2:
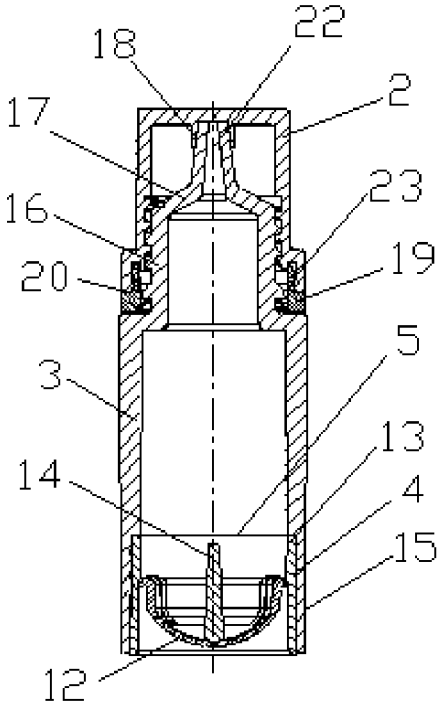
FIG. 2 is a section view of the first embodiment.

As shown in FIG. 1 and FIG. 2, a fresh-keeping bottle comprises a volumetric bottle 1 with a bottle cap 2, the volumetric bottle 1 comprises a bottle body 3 and a base, and the lower part of the bottle body 3 is clamped and fixed with the base.

The base comprises a flexible bottle bottom 12 and a cylindrical support 13, the bottle bottom 12 is a bowl-shape bottle bottom, the upper edge of bottle bottom 12 is fixed in the inner wall of a cylindrical support 13, the upper edge of bottle bottom 12 is adhered to and fixed with tinfoil 5, and the inner bottom part inside the bottle bottom 12 is fixed with an upward sharp protrusion 14.

The outside of the end face of the lower part of the bottle body 3 is provided with an annular extension wall 15 along the direction of the bottle body, and the annular extension wall 15 is fixed with the cylindrical support 13 through a buckled sealing structure 4.

The upper part of the bottle body 3 is shrunk into continuous bottle neck 16 and bottle tip 17, the bottle neck 16 is in thread tightening with the bottle cap 2, and the liquid squeezing outlet 22 is located in the bottle tip 17; the inner bottom of the bottle cap 2 is provided with a raised ring wall 18, and the bottle tip 17 is located in the raised ring wall 18.

The lower end of the bottle cap 2 is provided with a safety cap 19, the safety cap 19 is divided into upper and lower parts which are connected through a disconnecting point 20 that can be disconnected, and the upper part of the safety cap 19 is clamped and fixed with the inner wall of the opening at the lower edge of the bottle cap 2 through a clamping structure 23.

The method of the safety cap can further be existing common mode: the lower end of the bottle cap is provided with a safety cap, the safety cap is clamped and fixed in the bottle neck, and the bottle cap is connected to the safety cap through a disconnecting point that can be disconnected.

The preferred bottle body 3 is filled with a liquid, and the bottle bottom 12 is filled with solid powder.

According to the fresh-keeping bottle according to the present invention, the integrated bottle body 3 and base are made into two detachable containers, the two containers are separated by puncturable tinfoil 5, the bottle bottom 12 is made into flexible bottom, the bottle bottom has a sharp protrusion 14, and when the bottle bottom 12 is pressed, the tinfoil 5 is punctured by the protrusion 14, and the materials in the two containers are mutually mixed together. The liquid and the powder solid can be separately stored in the fresh-keeping bottle according to the present invention so that the liquid and the powder solid can be conveniently mixed in use, which provides a fresh-keeping effect to the powder solid in the storage and transmission process. Meanwhile, regarding to the mixed liquid, the bottle cap 2 is opened, the bottle bottom is inverted and pressed, and the mixed liquid in the bottle can be squeezed out from the liquid squeezing outlet 22. The flexible bottle bottom 12 has two effects, one is that the tinfoil 5 can be pressed to be punctured, and the other is that the liquid can be squeezed out.

Second Embodiment

Figure 3:
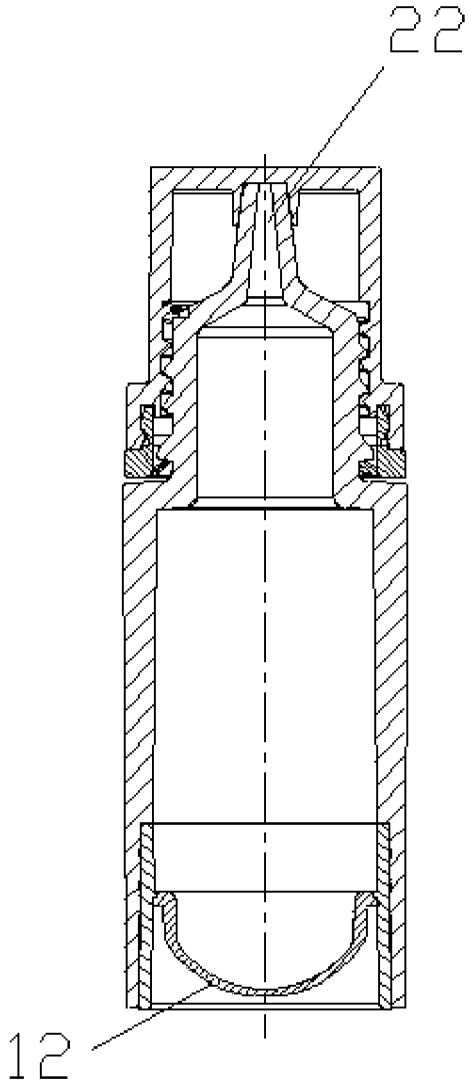
FIG. 3 is a section view of a second embodiment.
Figure 4:
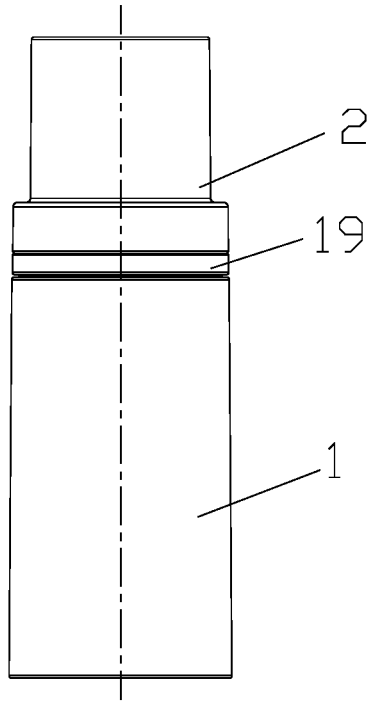
FIG. 4 is a schematic diagram showing an outline shape of a third embodiment.
Figure 5:
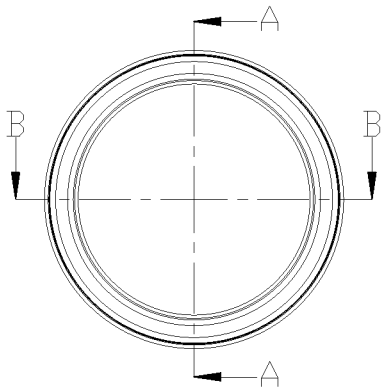
FIG. 5 is an upward view of the third embodiment.
Figure 6:
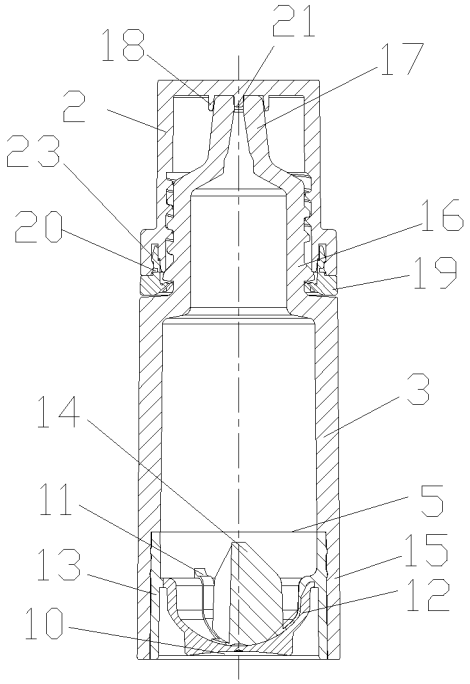
FIG. 6 is an A-A section view of the third embodiment.
Figure 7:
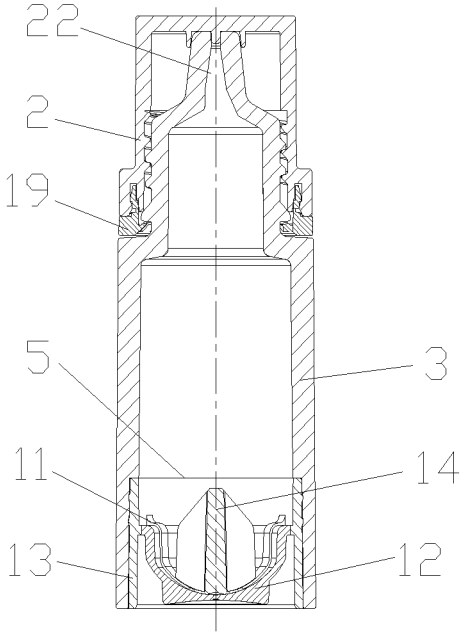
FIG. 7 is a B-B section view of the third embodiment.

As shown in FIG. 3, a package structure applied to dropping liquid that is simplified on the basis of the first embodiment according to the present invention does not need the tinfoil and the sharp protrusion. The liquid can be squeezed out from the liquid squeezing outlet 22 by pressing the bottle bottom 23 in use only without leakage, which is more convenient for use. The fresh-keeping bottle can further be combinedly used with the powder bottle in embodiment 5.

Third Embodiment

As shown in FIGS. 4, 5, 6 and 7, a fresh-keeping bottle according to the utility model comprises a volumetric bottle 1 with a bottle cap 2, the volumetric bottle 1 comprises a bottle body 3 and a base, and the lower part of the bottle body 3 is clamped and fixed with the base.

The base comprises a flexible bottle bottom 12 and a cylindrical support 13, the bottle bottom 12 is a bowl-shaped bottle bottom, the outer bottom of the bottle bottom is provided with a concave pressing point 10, the upper edge of the bottle bottom 12 is fixed in the inner wall of the cylindrical support 13, the inner wall of the cylindrical support 13 is further fixed with three hard tiepieces 11, and the hard tiepiece 11 is radially and tightly adhered to the inner wall of the bottle bottom 12. The upper edge of the bottle bottom 12 is adhered to and fixed with the tinfoil 5, and the middle position of the hard tiepiece 11 located at the inner bottom part inside the bottle bottom 12 is fixed with an upward sharp protrusion 14.

The outside of the end face of the lower part of the bottle body 3 is provided with an annular extension wall 15 along the direction of the bottle body, and the inner wall of the annular extension wall 15 is fixed with the outer wall of the cylindrical support 13 through a buckled sealing structure.

The upper part of the bottle body 3 is shrunk into continuous bottle neck 16 and bottle tip 17, the bottle neck 16 is in thread tightening with the bottle cap 2, the liquid squeezing outlet 22 is located in the bottle tip 17; the inner bottom of the bottle cap 2 is provided with a raised ring wall 18, the middle of the ring wall 18 is provided with a convex plug 21, the bottle tip 17 is located in the raised ring wall 18, and the plug 21 is inserted in the liquid squeezing outlet 22.

The lower end of the bottle cap 2 is provided with a safety cap 19, the safety cap 19 is divided into upper and lower parts which are connected through a disconnecting point 20 that can be disconnected, and the upper part of the safety cap 19 is clamped and fixed with the inner wall of the opening at the lower edge of the bottle cap 2 through the clamping structure 23.

The method of the safety cap can further be existing common mode: the lower end of the bottle cap is provided with a safety cap, the safety cap is clamped and fixed in the bottle neck, and the bottle cap is connected to the safety cap through a disconnecting point that can be disconnected.

The preferred bottle body 3 is filled with a liquid, and the bottle bottom 12 is filled with solid powder. According to the fresh-keeping bottle according to the utility model, the integrated bottle body 3 and base are made into two detachable containers, the two containers are separated by puncturable tinfoil 5, the bottle bottom 12 is made into flexible bottom, the bottle bottom has a sharp protrusion 14, and when the bottle bottom 10 is pressed, the tinfoil 5 is punctured by the protrusion 14, and the materials in the two containers are mutually mixed together. The liquid and the powder solid, or the liquid and the other liquid, can be separately stored in the fresh-keeping bottle according to the utility model, so that it is convenient for mixing in use, which provides a fresh-keeping effect to the powder solid or the liquid in the storage and transmission process. Meanwhile, regarding to the mixed liquid, the bottle cap 2 is opened, the bottle bottom is inverted and pressed, and the mixed liquid in the bottle can be squeezed out from the liquid squeezing outlet 22. The flexible bottle bottom 12 has two effects, one is that the tinfoil 5 can be pressed to be punctured, and the other is that the liquid can be squeezed out. Regarding to the fresh-keeping bottle according to the utility model, the liquid can be squeezed out through pressing by single hand without leakage, which is convenient for using.

Fourth Embodiment

Figure 8:
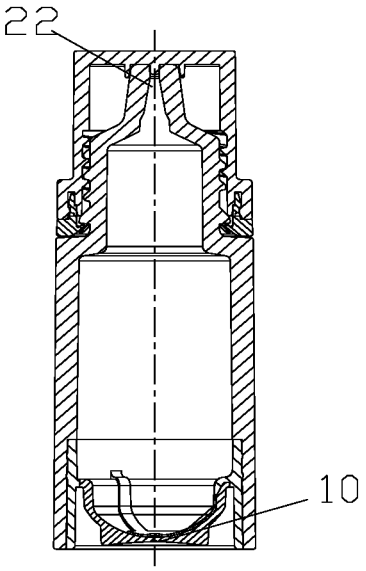
FIG. 8 is a section view of a fourth embodiment.

As shown in FIG. 8, a package structure applied to dropping liquid that is simplified on the basis of the first embodiment according to the utility model does not need the tinfoil and the sharp protrusion. The bottle cap is opened in using, the liquid can be squeezed out from the liquid squeezing outlet 22 by pressing the bottle bottom only without leakage, which is more convenient for use.

Fifth Embodiment

Figure 9:
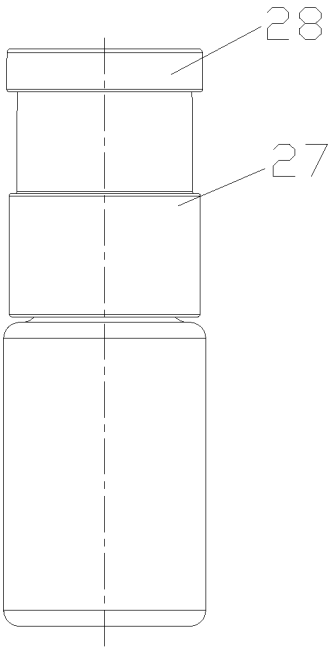
FIG. 9 is a schematic diagram showing an outline shape of a powder bottle in a fifth embodiment.
Figure 10:
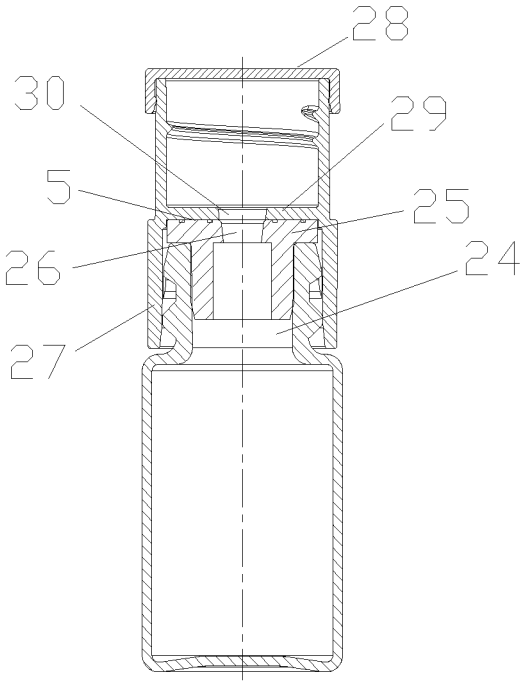
FIG. 10 is a section view of the fifth embodiment.

Based on the first embodiment, a powder bottle is added to be used for storing the solid powder, and the structure of the powder bottle is shown in FIGS. 9 and 10. The bottle opening 24 of the powder bottle is provided with a butyl rubber plug 25, the middle of the butyl rubber plug 25 is provided with a through hole 26, tinfoil 5 is adhered to and is fixed with the through hole 26, the outside of the bottle opening 24 is clamped and fixed with a cylindrical outer cap 27 with an inner wall provided with a convex ring, the upper end of the outer cap 27 is buckled with a detachable buckle cap 28, and the inside of the cylindrical outer cap 27 is provided with an inner thread meshed with the bottle neck 16.

The center of the inside of the cylindrical outer cap 27 is provided with a pressing plate 29, and the middle of the pressing plate 29 is provided with a pressing plate hole 30 corresponding to the through hole.

Figure 11:
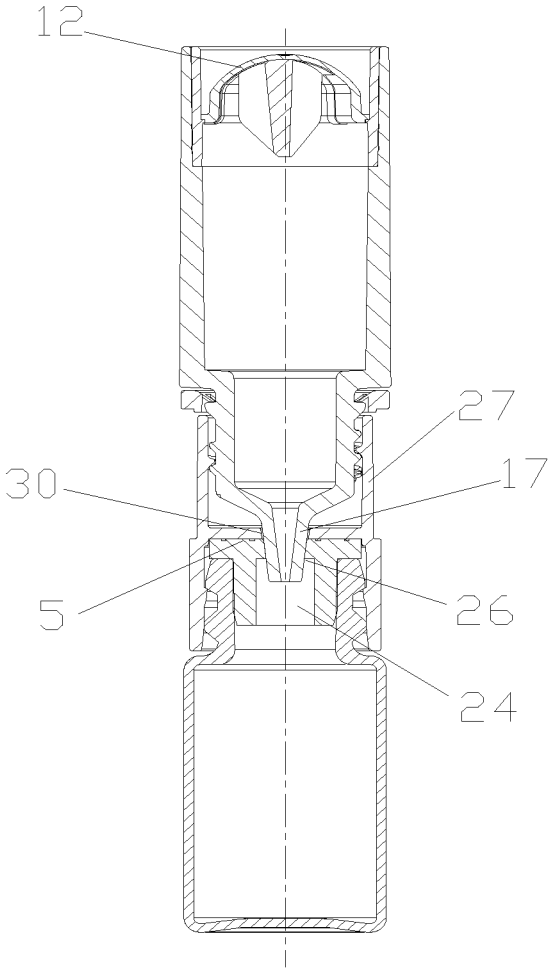
FIG. 11 is a use state diagram of the fifth embodiment.

The buckle cap is removed in using, the bottle tip 17 is inserted into the outer cap 27 to deepen through rotation, the bottle tip 17 penetrates the pressing plate hole 30 to puncture the tinfoil 5, and then penetrates the through hole 26 to stretch into the bottle opening 24, the bottle bottom 12 is pressed, and the liquid flows into the powder bottle for mixture. Refer to FIG. 11.

Figure 12:
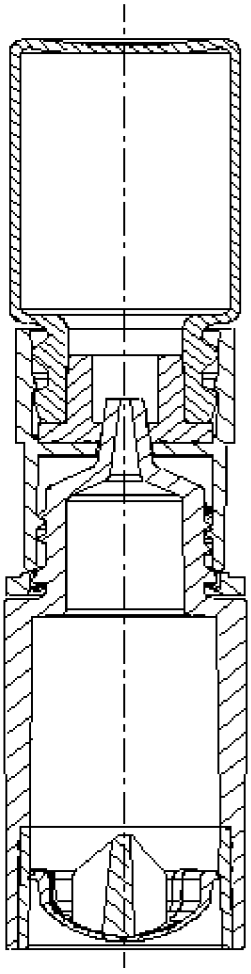
FIG. 12 is an inverted state diagram of the fifth embodiment.

After the powder is mixed, the bottle with the base is placed downwardly, the flexible bottom is pressed to discharge the air, the powder successively flows in, the two bottle bodies are separated in using, the powder solution can be dropped out through slightly pressing the bottle bottom only, which is convenient for use and is healthy. Refer to FIG. 12.

What is claimed is:

1. A fresh-keeping bottle, comprising:

a volumetric bottle with a bottle cap that includes a bottle body and a base, wherein:

an upper end of the bottle body is provided with a liquid squeezing outlet;

a lower part of the bottle body is fixed with the base;

the base includes a flexible bottle bottom and a cylindrical support; and an upper edge of the bottle bottom is fixed in an inner wall of the cylindrical support, wherein the upper edge of the bottle bottom is adhered to and fixed with a tinfoil; and an inner bottom part inside the bottle bottom is fixed with an upward sharp protrusion, and wherein an upper part of the bottle body is shrunk into a continuous bottle neck and a bottle tip; the bottle neck is in thread tightening with the bottle cap; and the liquid squeezing outlet is located in the bottle tip.

2. The fresh-keeping bottle according to claim 1, wherein:

an inner bottom of the bottle cap is provided with a raised ring wall; and the bottle tip is located in the raised ring wall.

3. The fresh-keeping bottle according to claim 1, wherein:

a wall of the bottle bottom is radially fixed with a hard tiepiece; and the sharp protrusion is fixed on the hard tiepiece in a middle of the bottle bottom.

4. The fresh-keeping bottle according to claim 3, wherein:

the bottle body is filled with a liquid; and the bottle bottom is filled with solid powder.

5. The fresh-keeping bottle according to claim 1, wherein:

the bottle bottom is in a bowl shape or in a cylindrical concave shape; and the cylindrical support is:

clamped in an inner end face of the lower part of the bottle body;

internally rotated in an inside thread of the lower part of the bottle body;

welded on an end face of steps in the lower part of the bottle body or a fractured face in the bottom through ultrasonic wave; or fixed in a lower end of the bottle body after being assembled through another part.

6. The fresh-keeping bottle according to claim 5, wherein:

an outside of an end face of the lower part of the bottle body is provided with an annular extension wall along the direction of a bottle body; and an annular extension wall is fixed with the cylindrical support through a buckled sealing structure.

7. The fresh-keeping bottle according to claim 5, wherein:

an outer bottom of the bottle bottom in a bowl shape or in a cylindrical concave shape is provided with a concave pressing point;

an outside of an end face of the lower part of the bottle body is provided with an annular extension wall along a direction of the bottle body; and an inner wall of an annular extension wall is fixed with an outer wall of the cylindrical support in a buckled sealing manner.

8. The fresh-keeping bottle according to claim 1, wherein:

a lower end of the bottle cap is provided with a safety cap;

the safety cap is clamped and fixed in the bottle neck; and the bottle cap is connected to the safety cap through a disconnecting point that can be disconnected.

9. The fresh-keeping bottle according to claim 1, wherein:

a lower end of the bottle cap is provided with a safety cap;

the safety cap is divided into an upper part and a lower part, which are connected through a disconnecting point that can be disconnected; and the upper part of the safety cap is clamped and fixed with an inner wall of the opening at a lower edge of the bottle cap through a clamping structure.

10. The fresh-keeping bottle according to claim 2, further comprising:

a powder bottle, wherein:

a bottle opening of the powder bottle is provided with a butyl rubber plug;

wherein the middle of the butyl rubber plug is provided with a through hole;

a tinfoil is adhered to and is fixed with the through hole; and the bottle tip can puncture the tinfoil to penetrate through the through hole and stretch into the bottle opening.

11. The fresh-keeping bottle according to claim 10, wherein:

an outside of the bottle opening is clamped and fixed with a cylindrical outer cap with an inner wall provided with a convex ring;

an upper end of the outer cap is buckled with a detachable buckle cap; and an inside of the cylindrical outer cap is provided with an inner thread meshed with the bottle neck.

12. The fresh-keeping bottle according to claim 11, wherein:

a center of the inside of the cylindrical outer cap is provided with a pressing plate; and a middle of the pressing plate is provided with a pressing plate hole corresponding to the through hole.

13. The fresh-keeping bottle according to claim 1, wherein:

the bottle body and the cylindrical support are made of hard plastic PP/PS/AS/MS/PET/PETG; and the bottle bottom is made of flexible plastic TPE/TPR/TPU/silica gel/rubber.

* * * * *